US008136744B2

(12) United States Patent
Gerard et al.

(10) Patent No.: US 8,136,744 B2
(45) Date of Patent: Mar. 20, 2012

(54) EXTENDABLE SPRINKLER DEVICE

(76) Inventors: Herb Gerard, Mesa, AZ (US); William Cole, Arizona City, AZ (US)

( * ) Notice: Subject to any disclaimer, the term of this patent is extended or adjusted under 35 U.S.C. 154(b) by 0 days.

(21) Appl. No.: 12/249,481

(22) Filed: Oct. 10, 2008

(65) Prior Publication Data

US 2010/0090025 A1 Apr. 15, 2010

(51) Int. Cl.
*B05B 15/06* (2006.01)

(52) U.S. Cl. ..... 239/281; 239/200; 239/204; 239/282; 239/159; 239/160; 239/451; 92/52; 92/53

(58) Field of Classification Search ..... 239/159, 239/160, 161, 200, 203, 204, 205, 279, 280, 239/281, 282, 285, 451, 453; 92/51, 52, 92/53

See application file for complete search history.

(56) References Cited

U.S. PATENT DOCUMENTS

| | | | | | |
|---|---|---|---|---|---|
| 409,796 | A | * | 8/1889 | Magaldi | 169/70 |
| 1,769,944 | A | * | 7/1930 | Crisp | 285/119 |
| 1,906,621 | A | * | 5/1933 | Knuth | 239/204 |
| 2,614,887 | A | * | 10/1952 | Shields | 239/268 |
| 2,699,216 | A | * | 1/1955 | Allen | 169/43 |
| 2,994,482 | A | * | 8/1961 | Valois et al. | 239/117 |
| 3,727,841 | A | | 4/1973 | Hengesbach | |
| 4,357,860 | A | * | 11/1982 | Krzak | 454/71 |
| 4,525,999 | A | * | 7/1985 | Inman | 60/407 |
| 4,700,894 | A | | 10/1987 | Grzych | |
| 4,809,369 | A | * | 3/1989 | Bowden | 4/615 |
| 5,133,501 | A | | 7/1992 | Marshall | |
| 5,702,056 | A | * | 12/1997 | Yang | 239/206 |
| 6,158,678 | A | * | 12/2000 | Lange | 239/532 |
| 6,378,791 | B1 | * | 4/2002 | Perry et al. | 239/532 |
| 6,871,658 | B2 | | 3/2005 | Gjestvang | |
| 6,905,080 | B2 | | 6/2005 | Pohorecki | |
| 7,140,325 | B2 | | 11/2006 | Lowe et al. | |
| 7,156,323 | B2 | * | 1/2007 | Mikkelson | 239/280.5 |
| 7,258,172 | B2 | | 8/2007 | Thompson | |
| 2006/0011750 | A1 | | 1/2006 | Eldridge | |
| 2006/0175429 | A1 | | 8/2006 | Lanigan, Jr. et al. | |

FOREIGN PATENT DOCUMENTS

| | | |
|---|---|---|
| JP | 2005-248463 | 9/2005 |

* cited by examiner

*Primary Examiner* — Len Tran
*Assistant Examiner* — Trevor E McGraw
(74) *Attorney, Agent, or Firm* — Schmeiser, Olsen & Watts

(57) ABSTRACT

An extendable sprinkler device comprises a base cylinder having a first end fluidly communicable with a second end via a through passageway. A primary extension assembly is coupled within the through passageway of the base cylinder and is positionable between collapsed and extended positions. The primary extension assembly comprises a primary extension cylinder having a first end fluidly communicable with a second end via a through passageway. A stop is coupled to the first end of the primary extension cylinder. An actuator cylinder is coupled within the primary extension cylinder. The actuator cylinder comprises a first end fluidly communicable with a second end via a through passageway. The second end of the actuator cylinder is coupled with the second end of the primary extension cylinder.

20 Claims, 16 Drawing Sheets

EXTENDABLE SPRINKLER DEVICE

BACKGROUND

1. Technical Field

Aspects of this document relate generally to extendable sprinkler devices.

2. Background Art

Fire poses significant risks to people, animals, property and land, in terms of both physical safety and financial loss. Various sprinkler systems have been designed to provide fire protection in various outdoor locations, and indoor locations, such as residential, commercial, and government buildings.

SUMMARY

Aspects of this document relate to extendable sprinklers.

In one aspect, an extendable sprinkler device comprises a base cylinder having a first end fluidly communicable with a second end via a through passageway having a first interior diameter. A primary extension assembly is slidably coupled within the through passageway of the base cylinder and is positionable between a collapsed position and an extended position. The primary extension assembly comprises a primary extension cylinder having a first end fluidly communicable with a second end via a through passageway having a second interior diameter and a first exterior diameter smaller than the first interior diameter. The first end of the primary extension cylinder comprises a stop coupled thereto. An actuator cylinder is coupled within the through passageway of the primary extension cylinder. The actuator cylinder comprises a first end fluidly communicable with a second end via a through passageway having a third interior diameter and a second exterior diameter smaller than the second interior diameter, wherein the second end of the actuator cylinder is coupled with the second end of the primary extension cylinder.

Particular embodiments of an extendable sprinkler may include one or more of the following. The first end of the base cylinder may be coupled with a water supply fitting. The base cylinder may further comprise at least two perforations disposed adjacent to the second end of the base cylinder. The at least two perforations may be in fluid communication with the first end of the base cylinder when the primary extension assembly is in the extended position. The stop of the primary extension cylinder may be interposed between the at least two perforations and the second end of the base cylinder when the primary extension assembly is in the extended position. The at least two perforations may not be in fluid communication with the first end of the base cylinder and the stop of the primary extension cylinder may be interposed between the first end of the base cylinder and the at least two perforations when the primary extension assembly is in the collapsed position. The primary extension assembly may be substantially coextensive with the through passageway of the base cylinder when the primary extension assembly is in the collapsed position. The second end of the primary extension cylinder may comprise an end cap coupled thereto. The actuator cylinder may comprise one or more outlet slots disposed adjacent to its second end.

Particular embodiments of an extendable sprinkler may further include one or more of the following. A secondary extension cylinder may be provided. The secondary extension cylinder may comprise a first end fluidly communicable with a second end via a through passageway having a fourth interior diameter and a third exterior diameter smaller than the third interior diameter. The secondary extension cylinder may be slidably coupled within the through passageway of the actuator cylinder and may be positionable between a collapsed position and an extended position. The first end of the secondary extension cylinder may comprise one or more stops coupled thereto. The secondary extension cylinder and the actuator cylinder may be substantially coextensive when the secondary extension cylinder is in the collapsed position. The secondary extension cylinder may comprise a spray nozzle coupled with its second end. The secondary extension cylinder comprise at least two perforations disposed adjacent to its second end. The one or more outlet slots of the actuator may be in fluid communication with the first end of the actuator cylinder when the secondary extension cylinder is in the extended position. At least one of the one or more stops of the secondary extension cylinder may be interposed between the one or more outlet slots and the second end of the actuator cylinder when the secondary extension cylinder is in the extended position.

Particular embodiments of an extendable sprinkler may still further include one or more of the following. The one or more outlet slots may not be in fluid communication with the first end of the actuator cylinder and at least one of the one or more stops of the secondary extension cylinder may be interposed between the first end of the actuator cylinder and the one or more outlet slots when the secondary extension cylinder is in the collapsed position. A tertiary extension cylinder may be provided. The tertiary extension cylinder may be slidably coupled within the secondary extension cylinder and may be positionable between a collapsed position and an extended position. The tertiary expansion cylinder may comprise a first end fluidly communicable with a second end via a through passageway having a fifth interior diameter and a fourth exterior diameter smaller than the fourth interior diameter, the first end having one or more stops coupled thereto. The at least two perforations of the secondary extension cylinder may be in fluid communication with the first end of the secondary extension cylinder when the tertiary extension cylinder is in the extended position. The stop of the tertiary extension cylinder may be interposed between the at least two perforations and the second end of the secondary extension cylinder when the tertiary extension cylinder is in the extended position. The stop of the tertiary extension cylinder may be interposed between the first end of the secondary extension cylinder and the at least two perforations of the secondary extension cylinder when the tertiary extension cylinder is in the collapsed position. The tertiary extension cylinder may comprise a spray nozzle coupled with its second end.

Particular embodiments of an extendable sprinkler may yet further include one or more of the following. A handle assembly may be coupled with the base cylinder. The handle assembly comprises a handle having two opposing side members coupled with a forward portion having one or more grips and a rear portion having one or more grips and a cuff pivotably coupled with the handle via two opposing pivots coupled with the opposing side members, the cuff located between the at least two opposing side members and the forward portion and the rear portion of the handle.

The foregoing and other aspects, features, and advantages will be apparent to those of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DESCRIPTION

Figure 1:
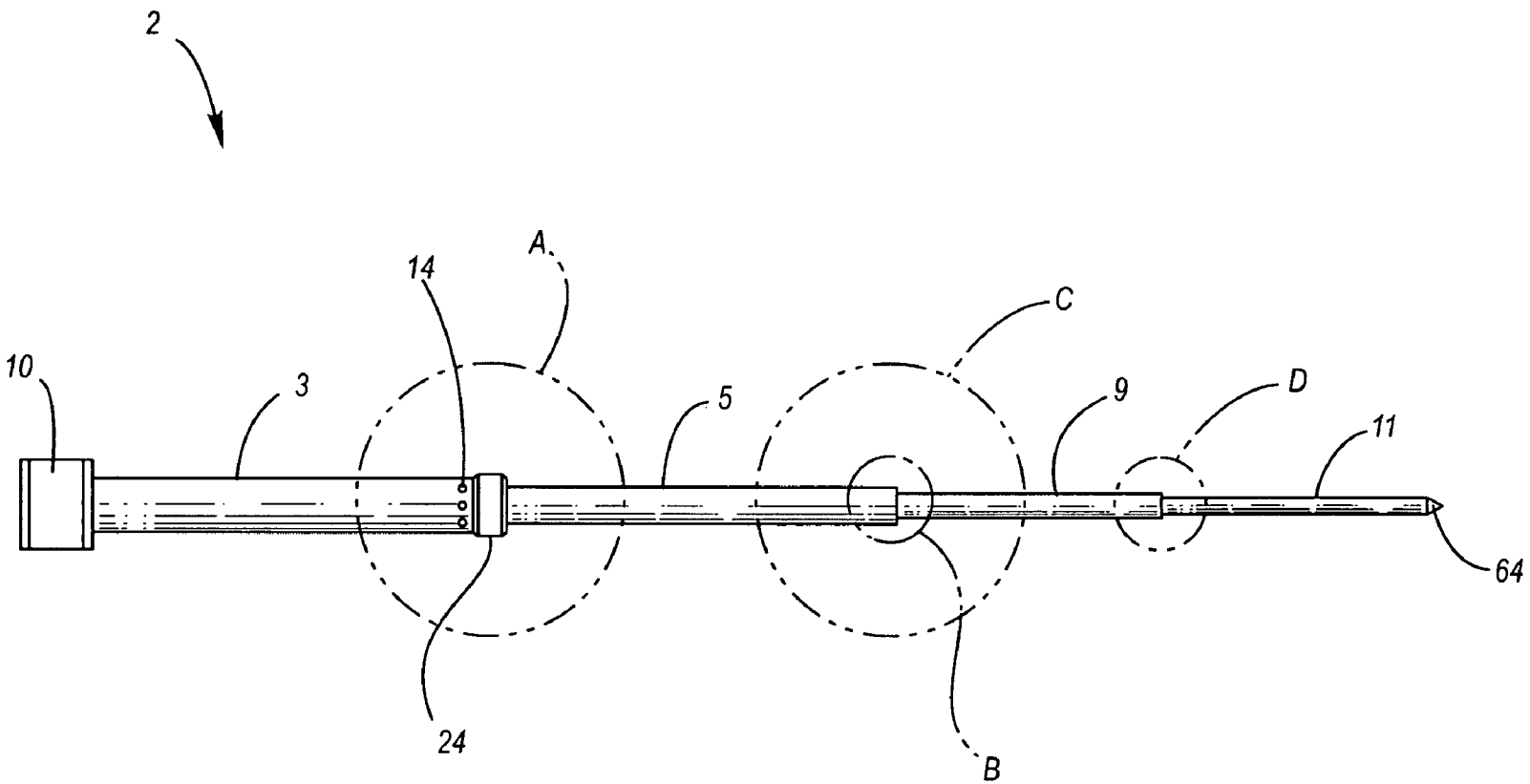
FIG. 1 is a perspective view of a first particular implementation of an extendable sprinkler in an extended position.

This disclosure, its aspects and implementations, are not limited to the specific components or assembly procedures disclosed herein. Many additional components and assembly procedures known in the art consistent with the intended operation and/or assembly procedures for a extendable sprinkler device will become apparent for use with implementations of extendible sprinkler devices from this disclosure. Accordingly, for example, although particular extendable sprinkler devices, base cylinders, primary extension assemblies, primary extension cylinders, actuator cylinders, secondary extension cylinders, tertiary extension assemblies, water supply fittings, bushings, end caps, water outlets, flanges, stops, valves, cuffs, perforations, nozzles, and handle assemblies are disclosed, such extendable sprinkler devices, base cylinders, primary extension assemblies, primary extension cylinders, actuator cylinders, secondary extension cylinders, tertiary extension cylinders, and implementing components may comprise any shape, size, style, type, model, version, measurement, concentration, material, quantity, and/or the like as is known in the art for such extendable sprinkler devices, consistent with the intended operation of an extendable sprinkler device.

There are a variety of possible extendable sprinkler implementations. FIGS. 1-12 illustrate a various embodiments of an extendable sprinkler device. With respect to FIG. 1, this figure illustrates a first particular implementation of an extendable sprinkler device in an extended position. In some particular implementations, an extendable sprinkler device may partially or fully extend when water is provided to the device under pressure such as, by way of non-limiting example, water supplied via a water supply fitting at a pressure of about 40 p.s.i. to about 5,000 p.s.i. Extendable sprinkler device 2 comprises base cylinder 3, which is fluidly communicable with primary extension assembly 16. By fluidly communicable, it is meant that base cylinder 3 is capable of being in fluid communication with primary extension assembly 16 such as, by way of non-limiting example, when primary extension assembly 16 is in an extended position with respect to base cylinder 3. It will be understood that, with respect to any of the cylinders described and disclosed herein (such as, by way of non-limiting example, base cylinder 3), such cylinders may comprise, any curvilinear or rectilinear shape including, by way of non-limiting example, circular, oval, square and/or octagonal (when viewed from end).

Primary extension assembly 16 comprises primary extension cylinder 5 and actuator cylinder 7 (which is coupled with and located inside primary extension cylinder 5; shown in FIGS. 2, 5, and 9-10). In this particular implementation, extendable sprinkler device 2 further comprises secondary extension cylinder 9 (FIGS. 2, 5, and 8), which is fluidly communicable with primary extension assembly 16. In addition, in the particular implementation shown, tertiary extension cylinder 11 is fluidly communicable with secondary extension cylinder 9. It will be understood that, in particular implementations, one or more bushings, gaskets, or other sealing devices known in the art may be used to form a seal or other water-resistant barrier between one or more of: base cylinder 3 and primary extension assembly 16; primary extension cylinder 5 and actuator cylinder 7; secondary extension cylinder 9 and actuator cylinder 7; and between the tertiary extension cylinder 11 and secondary extension cylinder 9. Notwithstanding, it will be further understood that, in other particular implementations, one or more such bushings, gaskets and/or other sealing devices may be omitted.

Figure 2:
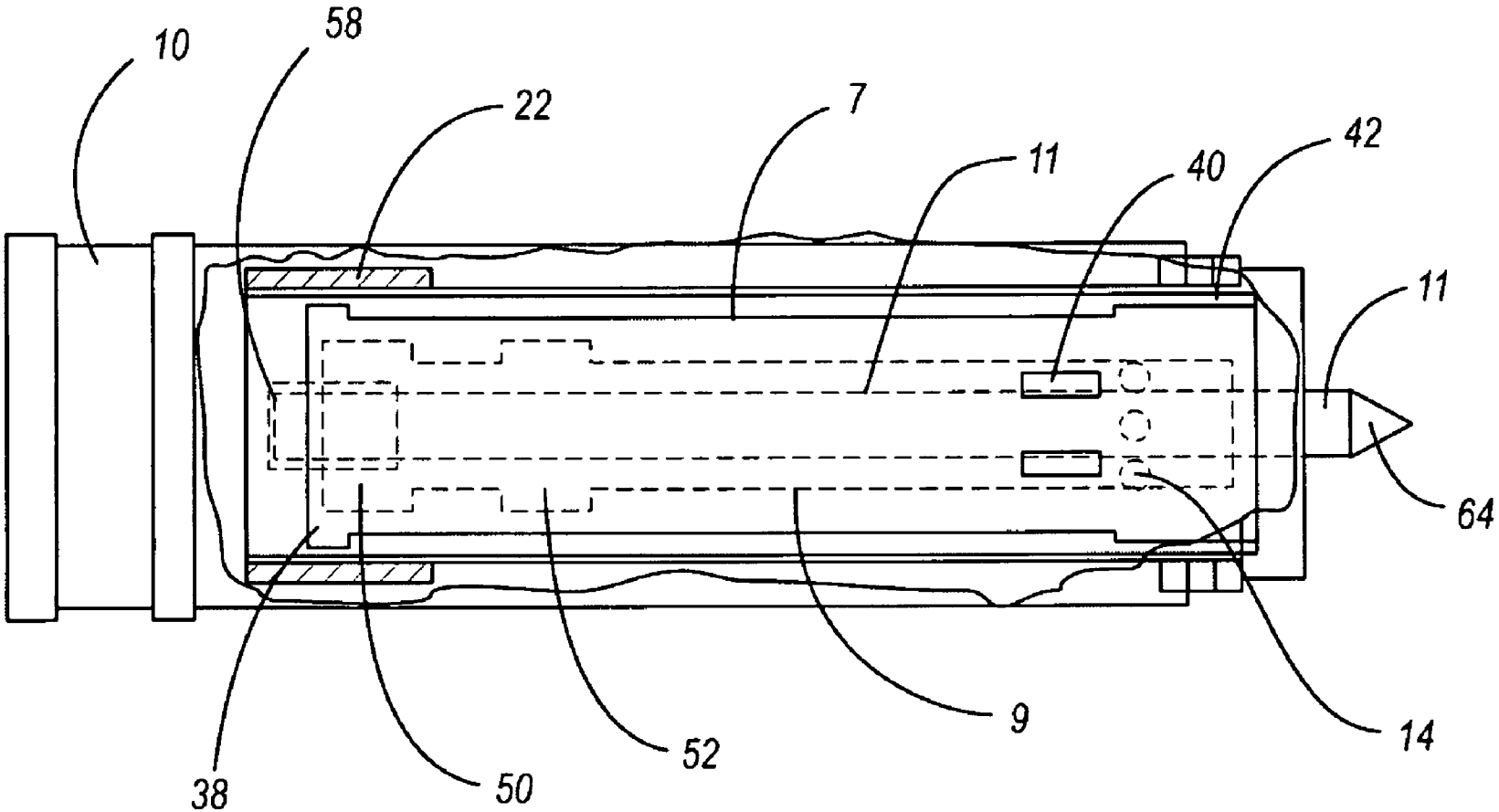
FIG. 2 is an assembled cut-away view of a first particular implementation of a extendable sprinkler in a collapsed position.
Figure 3:
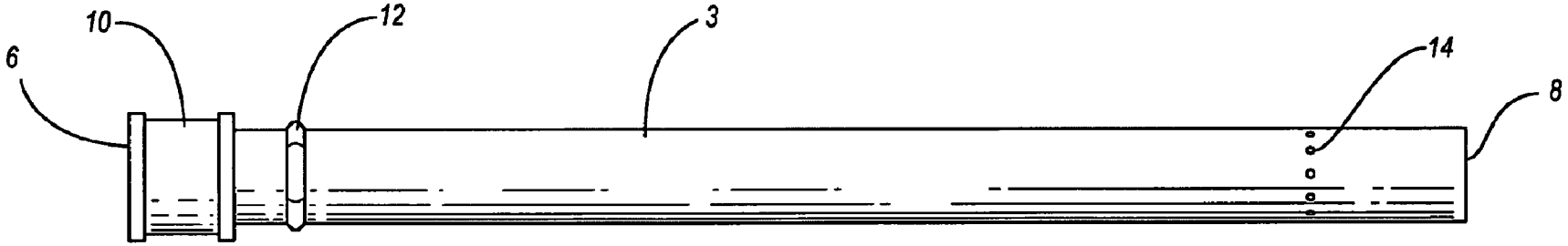
FIG. 3 is a disassembled perspective view of a base cylinder.

A comparison of FIG. 1 to FIG. 2 shows that: primary extension assembly 16 is slidably coupled with, and moveable between expanded and collapsed positions with respect to, base cylinder 3; secondary extension cylinder 9 is slidably coupled with, and moveable between expanded and collapsed positions with respect to, actuator cylinder 7; and tertiary extension cylinder 11 is slidably coupled with, and moveable between expanded and collapsed positions with respect to, secondary extension cylinder 9, each of which is further described below with respect to FIGS. 8-11 (which illustrate detail views A-D of FIG. 1*a*). In particular, FIG. 2 illustrates that primary extension assembly 16 (comprising primary extension cylinder 5 and actuator cylinder 7) is substantially coextensive with base cylinder 3 when primary extension assembly 16 is in the collapsed position with respect to base cylinder 3. In particular, when primary extension assembly 16 is slid to the collapsed position with respect to base cylinder 3, primary extension assembly 16 slides within base cylinder 3 until the exterior of primary extension cylinder 5 is substantially coextensive with the interior of base cylinder 3.

Still referring to FIG. 2, when secondary extension cylinder 9 is in the collapsed position with respect to actuator cylinder 7, secondary extension cylinder 9 is substantially coextensive with actuator cylinder 7. Specifically, when secondary extension cylinder 9 is slid to the collapsed position with respect to actuator cylinder 7, secondary extension cylinder 9 slides within actuator cylinder 7 until the exterior of secondary extension cylinder 9 is substantially coextensive with the interior of actuator cylinder 7. In addition, as illustrated in FIG. 2, when tertiary extension cylinder 11 is in the collapsed position with respect to secondary extension cylinder 9, tertiary extension cylinder 11 is substantially coextensive with secondary extension cylinder 9. In particular, when tertiary extension cylinder 11 is slid to the collapsed position with respect to secondary extension cylinder 9, tertiary extension cylinder 1 slides within secondary extension cylinder 9 until the exterior of tertiary extension cylinder 11 is substantially coextensive with the interior of secondary extension cylinder 9.

Turning now to FIGS. 3-7, these illustrate individually the base cylinder 3, primary extension cylinder 5, actuator cylinder 7, secondary extension cylinder 9, and tertiary extension cylinder 11 of the first implementation, respectively. With specific reference to FIG. 3, this figure illustrates base cylinder 3 according to the first particular implementation. In particular, base cylinder 3 comprises first end 6 and second end 8, which are fluidly communicable with one another via a through passageway having a first interior diameter. First end 6 is coupled with water supply fitting 10, through which water may be introduced into base cylinder 3. In some particular implementations, water supply fitting 10 may be coupled with first end 6 via a bushing 12 (which may comprise any bushing, gasket, or other seal configurable to resist the leakage of water from between two parts.

Figure 4:
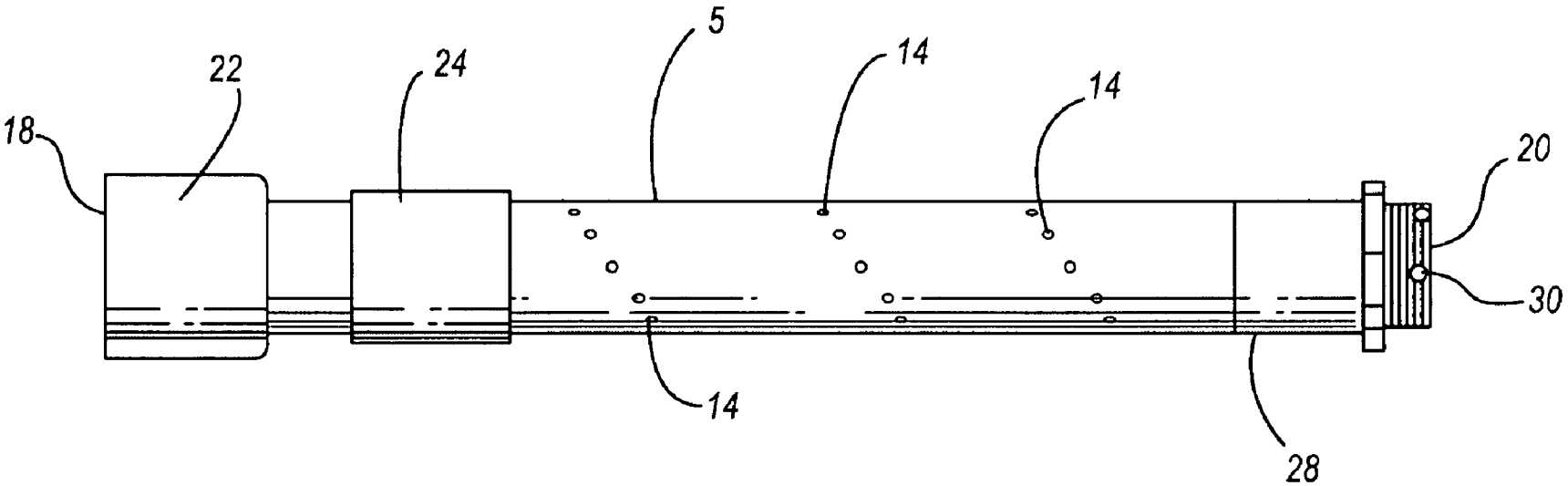
FIG. 4 is a disassembled perspective view of a primary extension cylinder.
Figure 8:
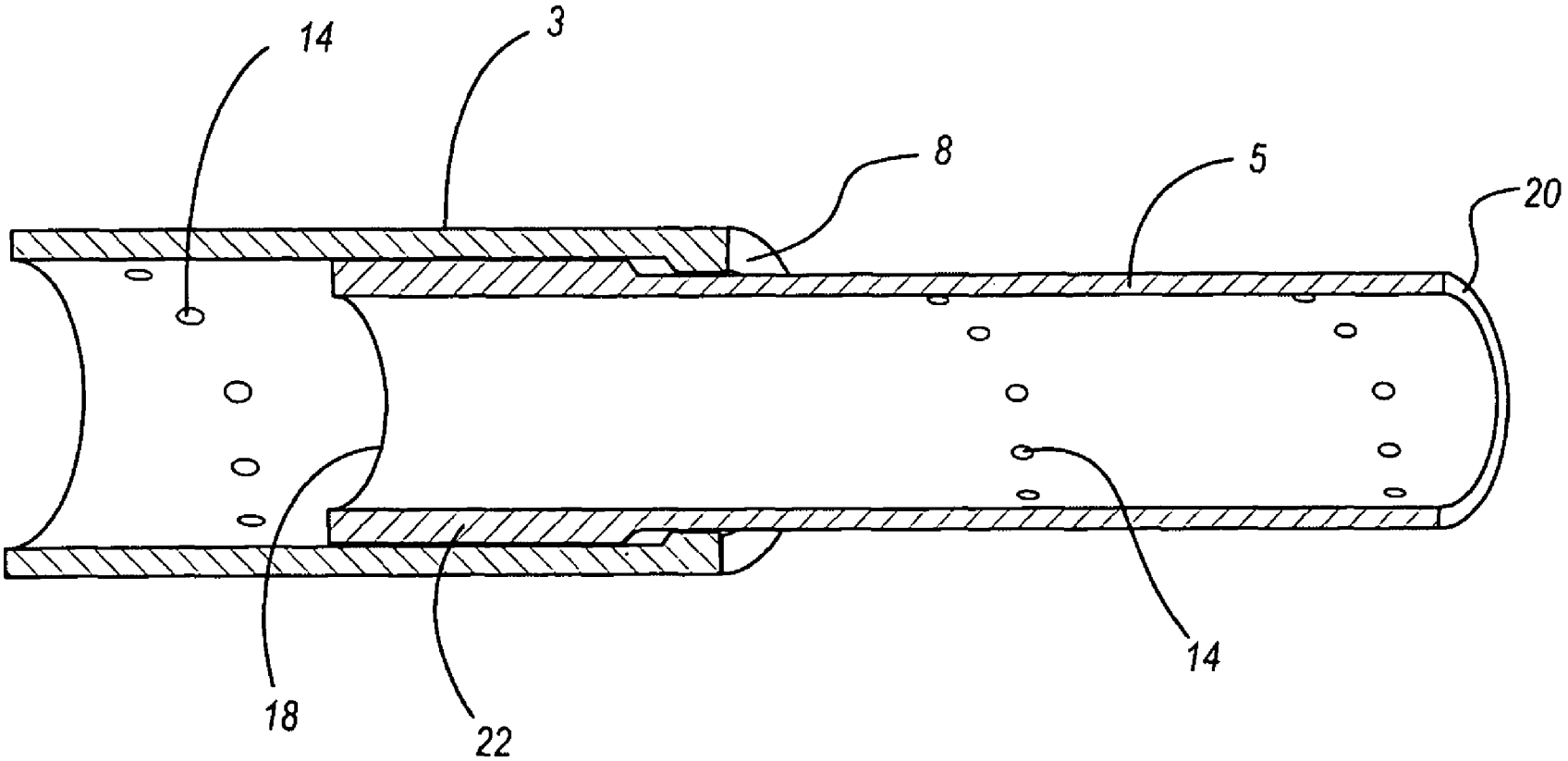
FIG. 8 is a detail view of detail section "A" of FIG. 1.

FIG. 4 illustrates a primary extension cylinder 5 in accordance with the first particular implementation of an extendable sprinkler device. As noted above, and as illustrated in FIGS. 1 and 2, primary extension cylinder 5 (and primary extension assembly 16) is slidably coupled with, and moveable between expanded and collapsed positions with respect to, base cylinder 3. Primary extension cylinder 5 comprises first end 18 and second end 20 which are fluidly communicable with one another via a through passageway having a second interior diameter (which is smaller than the first interior diameter of base cylinder 3), and a first exterior diameter smaller than the first interior diameter of base cylinder 3. Adjacent to first end 18 is coupled with stop 24 which, as illustrated in FIG. 8, acts in mechanical cooperation with second end 8 of base cylinder 3 to resist the decoupling of primary extension cylinder 5 from base cylinder 3 such as, by way of non-limiting example, when primary extension cylinder 5 is moved to an extended position with respect to base cylinder 3. In some particular implementations, stop 24 (and any or all other stops disclosed herein) may comprise a cuff, sleeve, or other structure mounted above the surface of primary extension cylinder 5 (or another cylinder disclosed herein). In other particular implementations, stop 24 (and any or all other stops disclosed herein) may comprise an integral or integrated portion raised above the exterior surface of primary extension cylinder 5 (or any other cylinder disclosed herein). The operation of stop 24 is further described below with respect to FIG. 8 (Detail "A" of FIG. 1). Referring still to FIG. 4, second end 20 of primary extension cylinder 5 is coupled with end cap 28. End cap 28 may comprise any cap-like structure. In the particular implementation shown, end cap 28 comprises a cap-like structure with a centrally-located through aperture through which a secondary extension cylinder (FIGS. 6 and 10) may be slidably positionable. Moreover, in the particular implementation shown, second end 36 of actuator cylinder 7 is coupled within second end 20 of primary extension cylinder 5. In some particular implementations, second end 36 of actuator cylinder 7 is coupled within second end 20 of primary extension cylinder 5 via the impingement of one or more set screws 30 of end cap 28 upon second end 36 of actuator cylinder 7. In other particular implementations, the one or more set screws 30 of end cap 28 may impinge upon second end 36 of actuator cylinder 7 via stop 42. In addition, first end 18 of primary extension cylinder 5 is fluidly communicable with one or more perforations 14 of primary extension cylinder 5 which, in the particular implementation shown, are disposed through, and along the length of, primary extension cylinder 5. It will be understood that, with respect to any of the perforations 14 described and disclosed herein (such as, by way of non-limiting example, one or more perforations 14 disposed about base cylinder 3, primary extension cylinder 5, secondary extension cylinder 9, tertiary extension cylinder 11 and, in particular implementations, actuator cylinder 7), such perforations may comprise, any shape, dimension, size, depth, or other characteristic.

In particular implementations, first end 18 of primary extension cylinder 5 is in fluid communication with one or more perforations 14 of primary extension cylinder 5 such as, by way of non-limiting example, when a stop 50 of a secondary extension cylinder 9 moves to an extended position (such as when stop 50 is moved between one or more perforations 14 of primary extension cylinder 5 and second end 36 of actuator cylinder 7). Primary extension cylinder 5 may further comprise bushing 22, which may fit over base cylinder 3 (when primary extension cylinder 5 is slidably coupled therein) and may resist the leaking of water between base cylinder 3 and primary extension cylinder 5.

Figure 5:
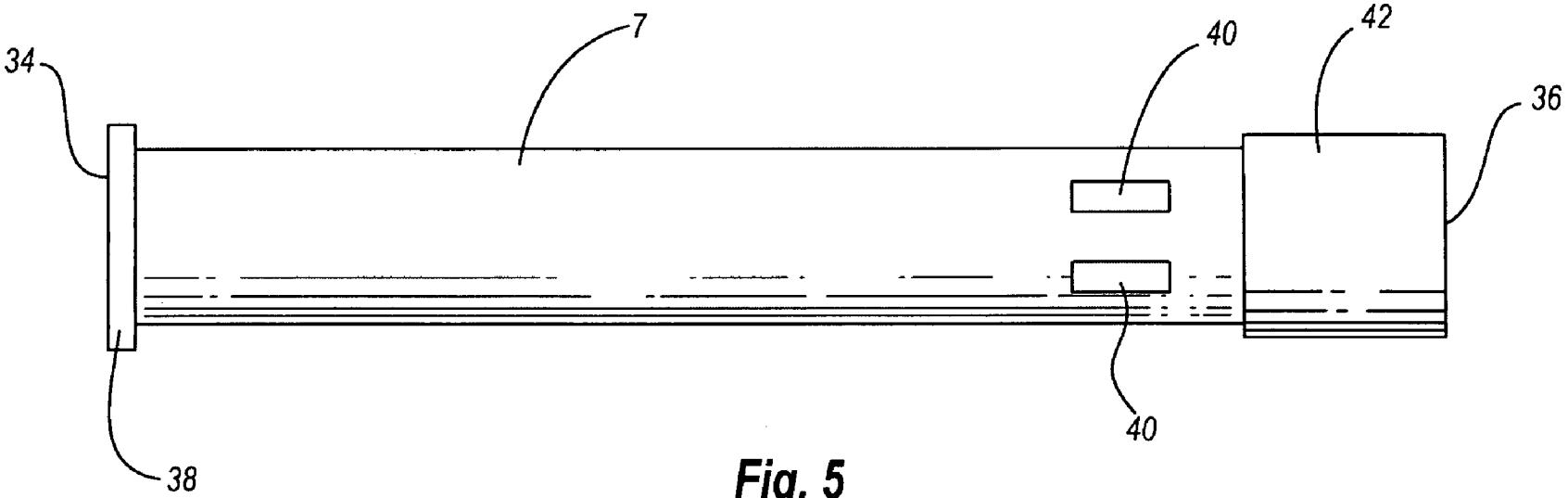
FIG. 5 is a disassembled perspective view of a actuator cylinder.
Figure 9:
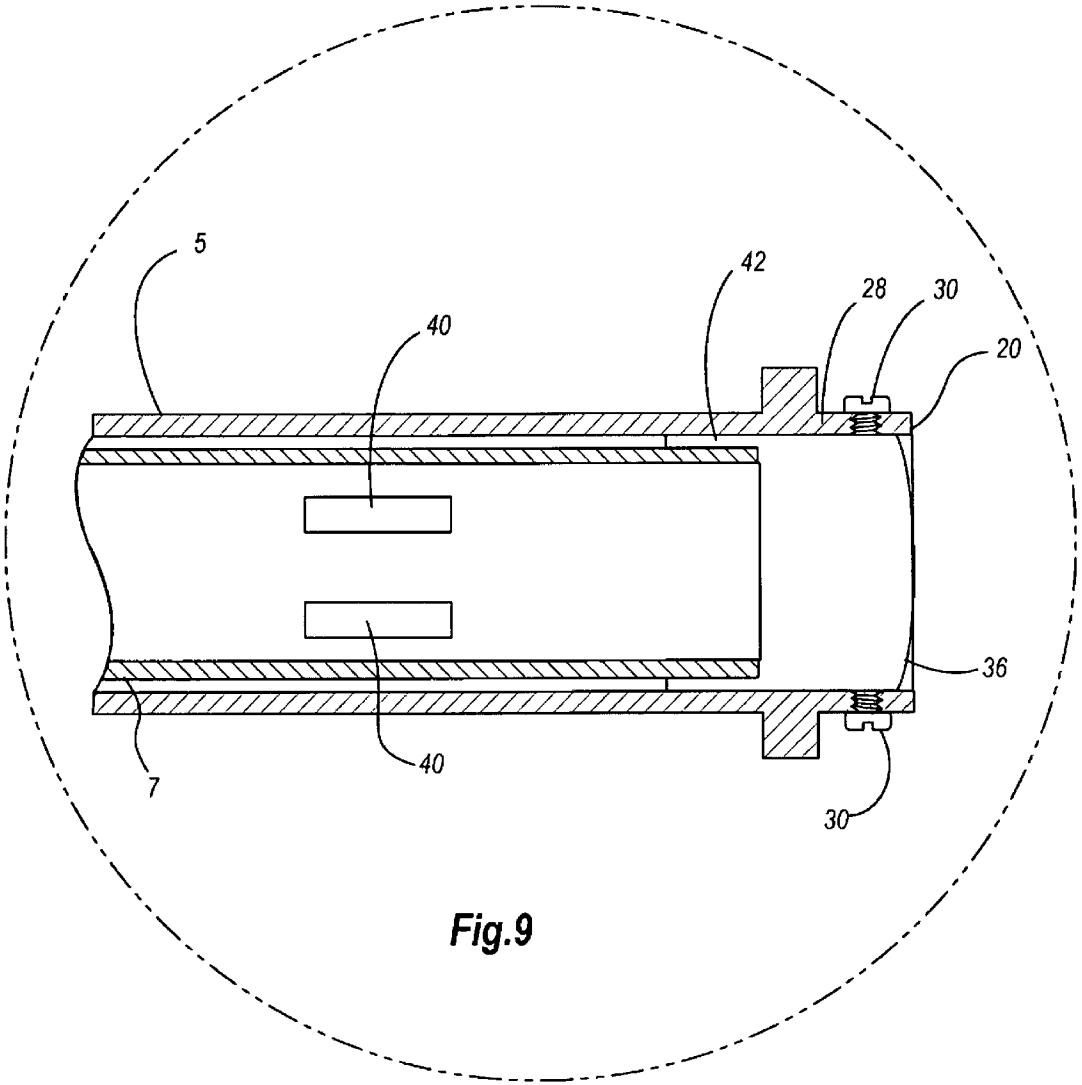
FIG. 9 is a detail view of detail section "B" of FIG. 1.
Figure 10:
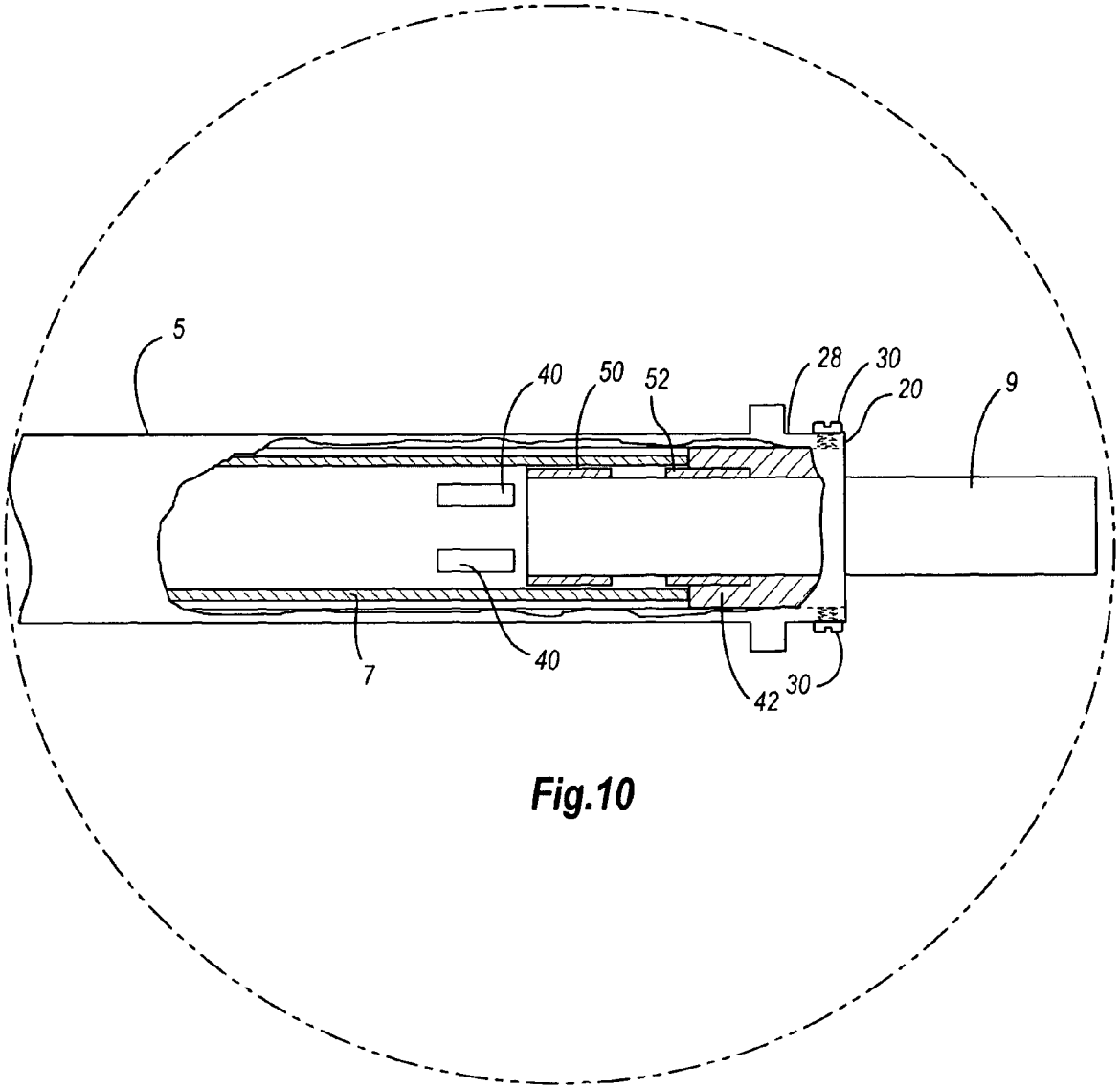
FIG. 10 is a detail view of detail section "C" of FIG. 1.

FIG. 5 illustrates actuator cylinder 7 which, together with primary extension cylinder 5 (FIG. 4), comprises primary extension assembly 16. Actuator cylinder 7 comprises first end 34 and second end 36 which are fluidly communicable with one another via a through passageway having a third interior diameter and a second exterior diameter smaller than the second interior diameter of primary extension cylinder 5. In the particular implementation shown, first end 34 comprises flange 38, and second end 36 is coupled with stop 42. As shown in FIGS. 9 and 10, actuator cylinder 7 is coupled with, and located inside, primary extension cylinder 5. Specifically, second end 36 of actuator cylinder 7 is coupled within end cap 28, forming primary extension assembly 16. With actuator cylinder 7 coupled within primary extension cylinder 5, primary extension assembly 16 may be slidably moved between extended and collapsed positions with respect to, and within, base cylinder 3. It will be understood that with actuator cylinder 7 coupled with primary extension cylinder 5, actuator cylinder 7 and primary extension cylinder 5 (primary extension assembly 16) may be slidably moved, as a single assembly, between extended and collapsed positions with respect to, and within, base cylinder 3. In particular implementations, second end 36 of actuator cylinder 7 may be coupled with end cap 28 via stop 42. As illustrated in FIG. 5, actuator cylinder 7 comprises one or more outlet slots 40 disposed through, and adjacent to, second end 36 of actuator cylinder 7. One or more outlet slots 40 may comprise any shape, depth, size, or diameter. It will be understood that, under appropriate conditions such as, by way of non-limiting example, when secondary extension cylinder 9 is moved to an extended position with respect to actuator cylinder 7 (as shown and described with respect to FIG. 10), an interior surface and an exterior surface of the actuator cylinder 7 are in fluid communication via the one or more water outlets 40.

Figure 6:
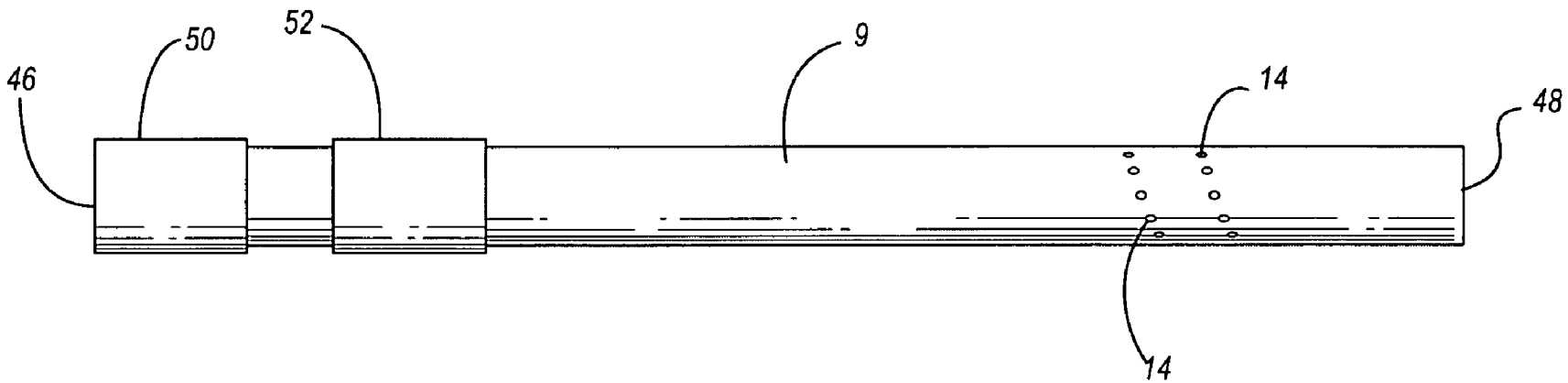
FIG. 6 is a disassembled perspective view of a secondary extension cylinder.

Referring now to FIG. 6, this figure illustrates a secondary extension cylinder 9 in accordance with the first particular implementation of an extendable sprinkler device. As noted above, and as illustrated in FIGS. 1 and 2, secondary extension cylinder 9 is slidably coupled with, and moveable between expanded and collapsed positions with respect to, actuator cylinder 7. Secondary extension cylinder 9 comprises first end 46 and second end 48 which are fluidly communicable with one another via a through passageway having a fourth interior diameter, and a third exterior diameter smaller than the third interior diameter of actuator cylinder 7. First stop 50 and second stop 52 are coupled with first end 46 of secondary extension cylinder 9. As illustrated in FIG. 10, stop 50 acts in mechanical cooperation with second end 36 of actuator cylinder 7 to resist the decoupling of secondary extension cylinder 9 from actuator cylinder 7 such as, by way of non-limiting example, when secondary extension cylinder 9 is moved to an extended position with respect to actuator cylinder 7. The operation of first stop 50 and second stop 52 is further described below with respect to FIG. 10 (Detail "C" of FIG. 1). Referring still to FIG. 6, secondary extension cylinder 9 may comprise one or more perforations 14 disposed therethrough, the one or more perforations 14 located adjacent to second end 48. In addition, an inside surface of secondary extension cylinder 9 is fluidly communicable with an outside surface of secondary extension cylinder via the one or more perforations 14.

Figure 7:
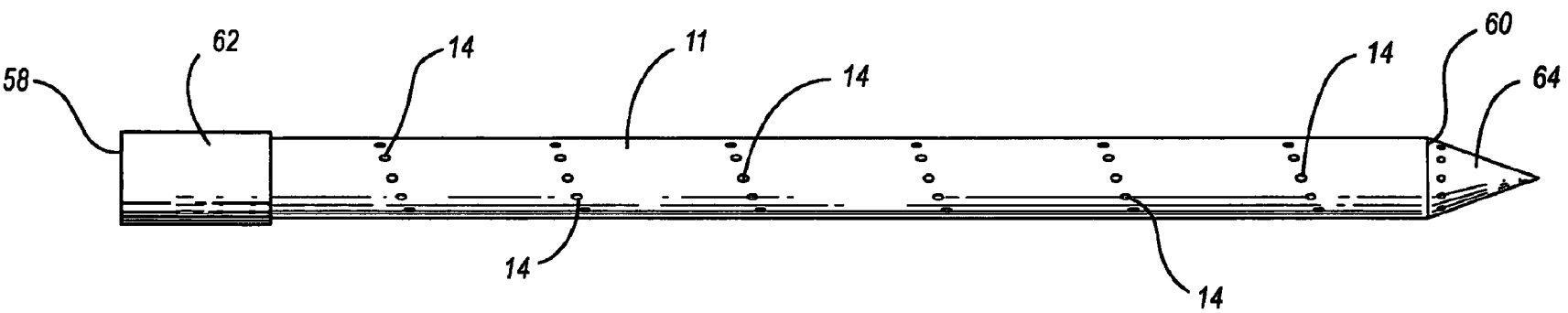
FIG. 7 is a disassembled perspective view of a tertiary extension cylinder.

FIG. 7 illustrates a tertiary extension cylinder 11 in accordance with the first particular implementation of an extendable sprinkler device. As noted above, and as illustrated in FIGS. 1 and 2, tertiary extension cylinder 11 is slidably coupled with, and moveable between expanded and collapsed positions with respect to, secondary extension cylinder 9. Tertiary extension cylinder 11 comprises first end 58 and second end 60 which are fluidly communicable with one another via a through passageway having a fifth interior diameter, and a fourth exterior diameter smaller than the fourth interior diameter of secondary extension cylinder 9. First end 58 is coupled with stop 62 which, as illustrated in FIG. 10, acts in mechanical cooperation with second end 48 of secondary extension cylinder 9 to resist the decoupling of tertiary extension cylinder 11 from secondary extension cylinder 9 such as, by way of non-limiting example, when tertiary extension cylinder 11 is moved to an extended position with respect to secondary extension cylinder 9. The operation of stop 24 is further described below with respect to FIG. 11 (Detail "D" of FIG. 1*a*). Referring still to FIG. 7, an inside surface of tertiary extension cylinder 11 is fluidly communicable with an outside surface of tertiary extension cylinder 11 via one or more perforations 14 which, in the particular implementation shown, are disposed through, and along the length of, tertiary extension cylinder 11. In the particular implementation shown, nozzle 64 is coupled with tertiary extension cylinder 11 (although, in other particular implementations, nozzle 64 may be removably coupled with primary extension cylinder 5, actuator cylinder 7, and/or secondary extension cylinder 9). Nozzle 64 may comprise any fitting configured to disperse water such as, by way of non-limiting example, the routing of a water stream through one or more perforations. In some particular implementations, nozzle 64 may be configured to be punched through solid surfaces such as, by way of non-limiting example, walls, doors, windows, ceilings, roofs, and other solid surfaces. Such configuration may include, by way of non-limiting example, structural reinforcement, various tapered tip configurations shaped to "spear" their way through solid surfaces, and/or spherical nozzle configurations. It will be understood that nozzle 64 may be removably coupled with primary extension cylinder 5 and/or actuator cylinder 7 in those implementations of an extendable sprinkler device having only a base cylinder 3 and primary extension assembly 16. It will be further understood that nozzle 64 may be coupled with secondary extension cylinder 9 in those implementations of an extendable sprinkler device having a secondary extension cylinder 9.

While FIGS. 1 and 2 illustrate a first particular implementation of an extendable sprinkler device having a secondary extension cylinder 9 and a tertiary extension cylinder 11, it will be understood that, in other particular implementations of an extendable sprinkler device, secondary extension cylinder 9 and/or tertiary extension cylinder 11 may be omitted. In those particular implementations of an extendable sprinkler device omitting both a secondary extension cylinder 9 and a tertiary extension cylinder 11, a nozzle 64 may be coupled with a second end 20 of primary extension cylinder 5. Notwithstanding, in those particular implementations of an extendable sprinkler device omitting a tertiary extension cylinder 11, a nozzle 64 may be coupled with a second end 48 of secondary extension cylinder 9.

As noted above, FIG. 8 illustrates Detail "A" of FIG. 1, which shows primary extension cylinder 5 slidably coupled within base cylinder 3 and in an extended position. When primary extension cylinder 5 reaches a fully extended position, at least a portion of stop 24 (coupled to first end 18 of primary extension cylinder 5) contacts second end 8 of base cylinder 3. It will be understood that the contact of stop 24 with second end 8 of base cylinder 3 may serve to resist the decoupling of primary extension cylinder 5 from base cylinder 3, as primary extension cylinder 5 moves towards an extended position with respect to base cylinder 3.

In addition to the foregoing, stop 24 may act as a valve with respect to the at least two perforations 14 disposed adjacent to second end 8 of base cylinder 3. In particular, as noted above with respect to FIG. 3, the at least two perforations 14 disposed in base cylinder 3 are in fluid communication with first end 6 of base cylinder 3 when primary extension cylinder 5 is moved towards an extended position with respect to base cylinder 3. Specifically, as primary extension cylinder 5 is moved towards an extended position, stop 24 will "clear" the at least two perforations 14 located on base cylinder 3 (as shown in FIG. 8), such that the at least two perforations 14 are in fluid communication with first end 6 of base cylinder 3 and that water may flow from first end 6 through the at least two perforations 14 on base cylinder 3. Accordingly, the at least two perforations 14 on base cylinder 3 may not be in fluid communication with first end 6 when primary extension cylinder 5 is in a collapsed position with respect to base cylinder 3 and stop 24 has not cleared the at least two perforations 14 on base cylinder 3 (FIG. 2). Therefore, when primary extension cylinder 5 is in an extended position with respect to base cylinder 3, stop 24 is interposed between the at least two perforations 14 and second end 8 of base cylinder 3. Thus, when primary extension cylinder 5 is in a collapsed position with respect to base cylinder 3, stop 24 is interposed between the at least two perforations 14 and first end 6 of base cylinder 3 (and the at least two perforations 14 are not in fluid communication with first end 6 of base cylinder 3). Of course, water flowing through base cylinder 3 (flowing from first end 6 to second end 8) that does not exit the at two least perforations 14 on base cylinder 3, may flow into primary extension cylinder 5.

Turning now to FIG. 9, this figure illustrates detail "B" of FIG. 1, which shows the coupling of actuator cylinder 7 within primary extension cylinder 5. In particular, actuator cylinder 7 is fixedly coupled within primary extension cylinder 5 such that when primary extension cylinder 5 is moved between a collapsed and an extended position with respect to base cylinder 3, primary extension assembly 16 (primary extension cylinder 5 and actuator cylinder 7) moves as a single assembly. Specifically, second end 36 of actuator cylinder 7 is coupled with second end 20 of primary extension cylinder 3. In the particular implementation shown, actuator cylinder 7 is coupled within primary extension cylinder 5 via the impingement of stop 42 (located at second end 36 of actuator cylinder 7) within end cap 28 of primary extension cylinder 5 (located at second end 20). Specifically, with stop 42 positioned within end cap 28, a user may tighten one or more set screws 30 (or use another type of fastener or welding), thereby impinging stop 42 within end cap 28 (via the impingement of the one or more set screws 30 with respect to stop 42). In some particular implementations, stop 42 may be omitted such that second end 36 of actuator cylinder 7 is directly coupled with second end 20 of primary extension cylinder 5 via one or more set screws 30, or other fastener or weld.

FIG. 10 illustrates detail "C," which shows secondary extension cylinder 9 slidably coupled within actuator cylinder 7 (of primary extension assembly 16), in an extended position. When secondary extension cylinder 9 reaches a fully extended position, at least a portion of stop 52 (coupled adjacent to first end 46 of secondary extension cylinder 9) contacts second end 36 of actuator cylinder 7. The contact of stop 52 with second end 36 of actuator cylinder 7 may serve to resist the decoupling of secondary extension cylinder 9 from base cylinder 3, as secondary extension cylinder 9 moves towards an extended position with respect to actuator cylinder 7. In some particular implementations, stop 52 may be omitted, so that stop 50 contacts second end 36 of actuator cylinder 7 when secondary extension cylinder 9 reaches a fully extended position.

In addition to the foregoing, stop 50 (and/or stop 52) may act as a valve with respect to the one or more outlet slots 40 disposed adjacent to second end 36 of actuator cylinder 7. In particular, as noted above with respect to FIG. 5, the one or more outlet slots 40 disposed adjacent to second end 36 of actuator cylinder 7 are in fluid communication with first end 34 of actuator cylinder 7 when secondary extension cylinder 9 is moved towards an extended position with respect to actuator cylinder 7. Specifically, as secondary extension cylinder 9 is moved towards an extended position, stop 50 will "clear" the one or more outlet slots 40 located on actuator cylinder 7 (as shown in FIG. 10), such that the one or more outlet slots 40 are in fluid communication with first end 34 of actuator cylinder 7 and that water may flow from first end 34 through the one or more outlet slots 40 on actuator cylinder 7. Accordingly, the one or more outlet slots 40 on actuator cylinder 7 may not be in fluid communication with first end 34 when secondary extension cylinder 9 is in a collapsed position with respect to actuator cylinder 7 and stop 50 has not cleared the one or more outlet slots 40 on actuator cylinder 7 (collapsed position illustrated in FIG. 2). Therefore, when secondary extension cylinder 9 is in an extended position with respect to actuator cylinder 7, stop 50 is interposed between the one or more outlet slots 40 and second end 36 of actuator cylinder 7. Thus, when secondary extension cylinder 9 is in a collapsed position with respect to actuator cylinder 7, stop 50 is interposed between the one or more outlet slots 40 and first end 34 of base cylinder 3 (and the one or more outlet slots 40 are not in fluid communication with first end 34 of actuator cylinder 7). Of course, water flowing through actuator cylinder 7 (flowing from first end 34 to second end 36) that does not exit the one or more outlet slots 40 on actuator cylinder 7, may flow into secondary extension cylinder 9.

Figure 11:
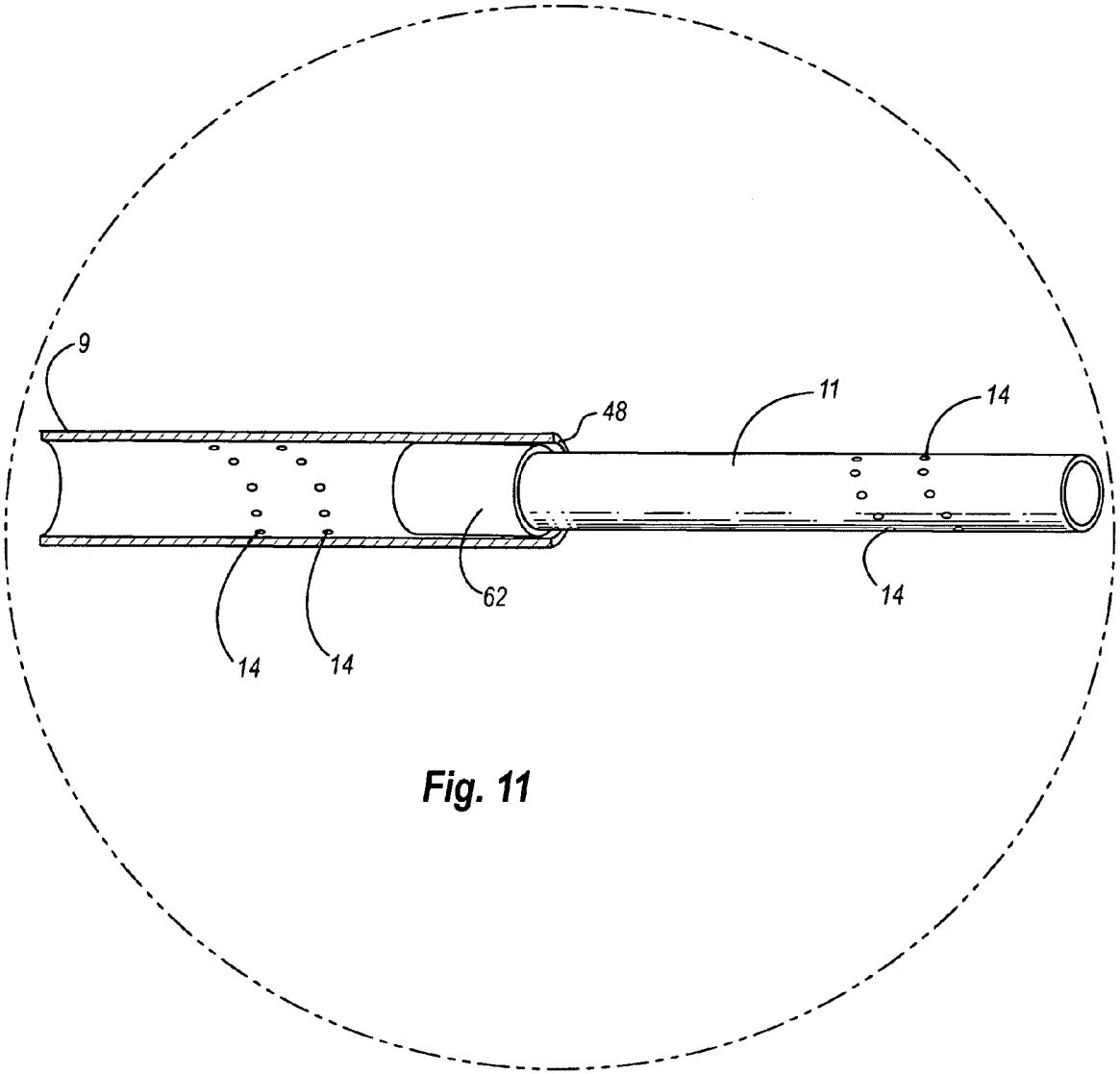
FIG. 11 is a detail view of detail section "D" of FIG. 1.

FIG. 11 illustrates Detail "D" of FIG. 1, which shows tertiary extension cylinder 11 slidably coupled within secondary extension cylinder 9, in an extended position. When tertiary extension cylinder 11 reaches a fully extended position (with respect to secondary extension cylinder 9), at least a portion of stop 62 (coupled to first end 58 of tertiary extension cylinder 11) contacts second end 48 of secondary extension cylinder 9. It will be understood that the contact of stop 62 with second end 48 of secondary extension cylinder 9 may serve to resist the decoupling of tertiary extension cylinder 11 from secondary extension cylinder 9, as tertiary extension cylinder 11 moves towards an extended position with respect to secondary extension cylinder 9.

In addition to the foregoing, stop 62 may act as a valve with respect to the at least two perforations 14 disposed adjacent to second end 48 of secondary extension cylinder 9. In particular, as noted above with respect to FIG. 6, the at least two perforations 14 disposed in secondary extension cylinder 9 are in fluid communication with first end 46 of secondary extension cylinder 9 when tertiary extension cylinder 11 is moved towards an extended position with respect to secondary extension cylinder 9. Specifically, as tertiary extension cylinder 11 is moved towards an extended position, stop 62 will "clear" the at least two perforations 14 located on secondary extension cylinder 9 (as shown in FIG. 11), such that the at least two perforations 14 are in fluid communication with first end 46 of secondary extension cylinder 9 and that water may flow from first end 46 through the at least two perforations 14 on secondary extension cylinder 9 (and so that an interior surface and an exterior surface of secondary extension cylinder 9 are thereby in fluid communication). Accordingly, the at least two perforations 14 on secondary extension cylinder 9 may not be in fluid communication with first end 46 when tertiary extension cylinder 11 is in a collapsed position with respect to secondary extension cylinder 9 and stop 62 has not cleared the at least two perforations 14 on secondary extension cylinder 9 (FIG. 2). Therefore, when tertiary extension cylinder 11 is in an extended position with respect to secondary extension cylinder 9, stop 62 (of tertiary extension cylinder 11) is interposed between the at least two perforations 14 and second end 48 of secondary extension cylinder 9. Thus, when tertiary extension cylinder 11 is in a collapsed position with respect to secondary extension cylinder 9, stop 62 is interposed between the at least two perforations 14 and first end 46 of secondary extension cylinder 9 (and the at least two perforations 14 are not in fluid communication with first end 46 of secondary extension cylinder 9). Of course, water flowing through secondary extension cylinder 9 (flowing from first end 46 to second end 48) that does not exit the at two least perforations 14 on secondary extension cylinder 9, may flow into tertiary extension cylinder 11.

Figure 12:
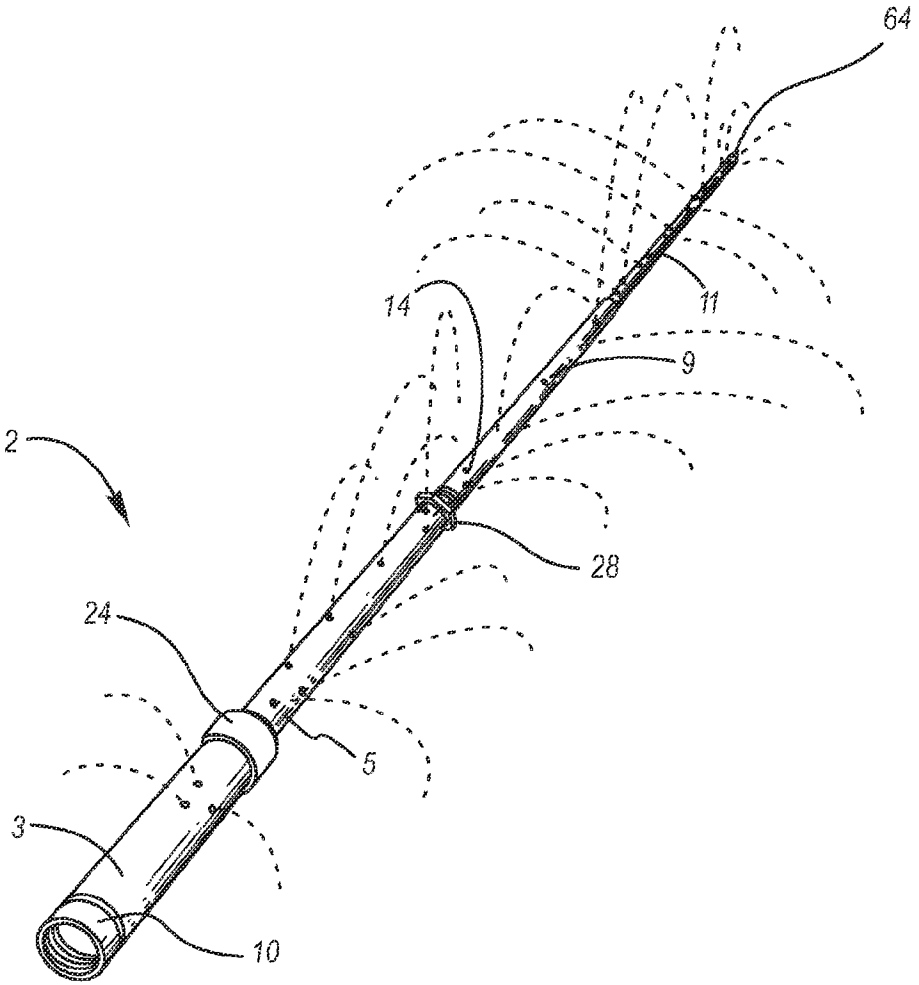
FIG. 12 is an assembled in-use view of an extendable sprinkler in an extended position.

FIG. 12 illustrates an assembled in-use view of an extendable sprinkler 2 in an extended position. With water supply fitting 10 connected to a water source and with water supplied to extendable sprinkler 2 under appropriate pressure which, in some particular implementations, may be at least 75 pounds per square inch (p.s.i.), primary extension assembly 16 may move to its extended position with respect to base cylinder 3, secondary extension cylinder 9 may move to its extended position with respect to primary extension assembly 16 (in particular, actuator cylinder 7), and tertiary extension 11 cylinder may move to its extended position with respect to secondary extension cylinder 9.

As illustrated in FIG. 12, water provided to extendable sprinkler 2 under appropriate pressure may flow through base cylinder 3, where the water may be dispersed at least through one or more perforations 14 of base cylinder 3. Water flowing from base cylinder 3 into primary extension cylinder 5 may exit primary extension cylinder 5 at least through one or more perforations 14 on primary extension cylinder 5. Water flowing from primary extension cylinder 5 into secondary extension cylinder 9 may exit secondary extension cylinder 9 at least through one or more perforations 14 on secondary extension cylinder 9. Water flowing from secondary extension cylinder 9 into tertiary extension cylinder 11 may exit tertiary extension cylinder 11 at least through one or more perforations 14 on tertiary extension cylinder 11 (and/or via nozzle 64).

Figure 13:
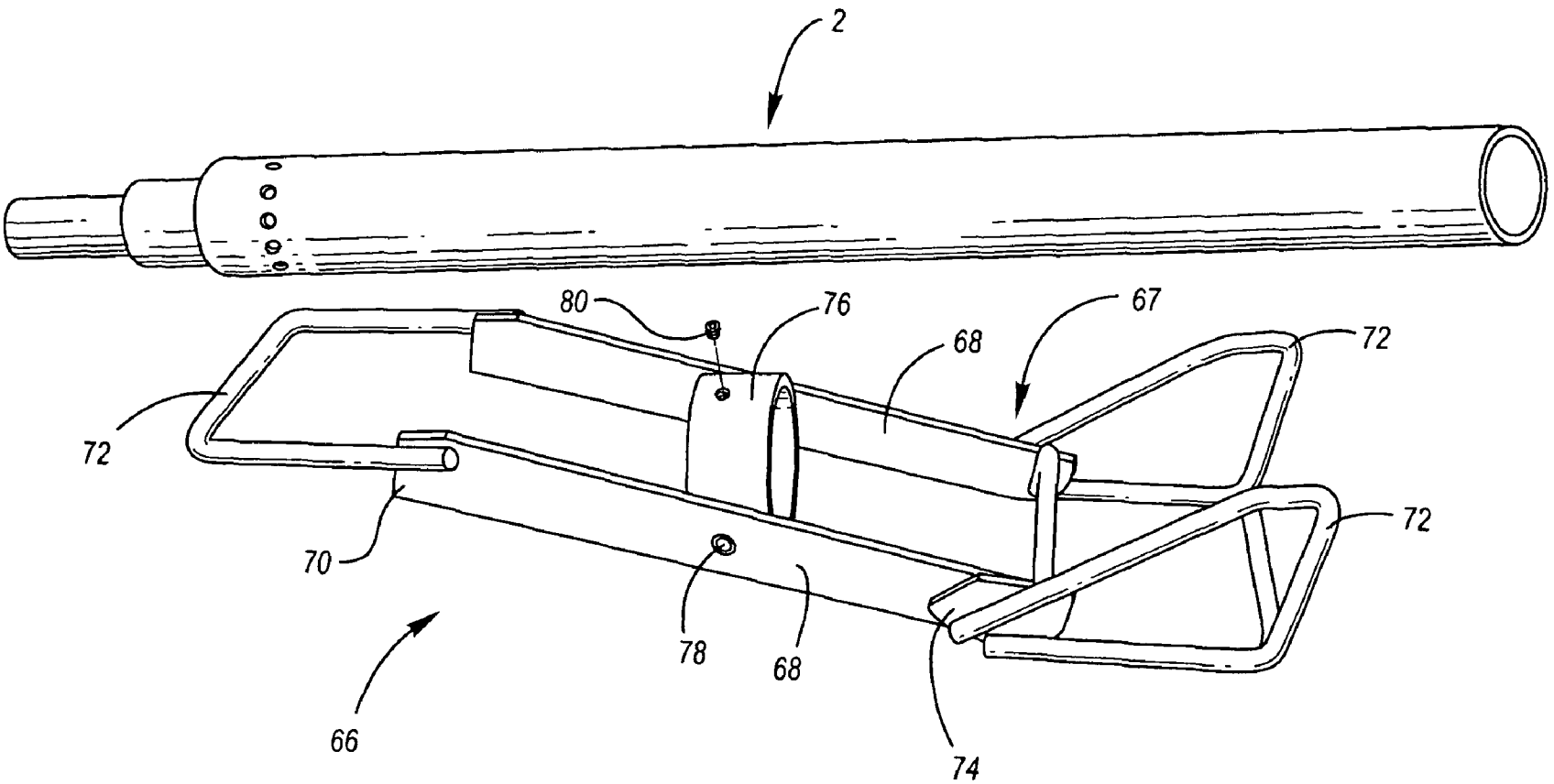
FIG. 13 is a perspective view of a first particular implementation of a handle.
Figure 14:
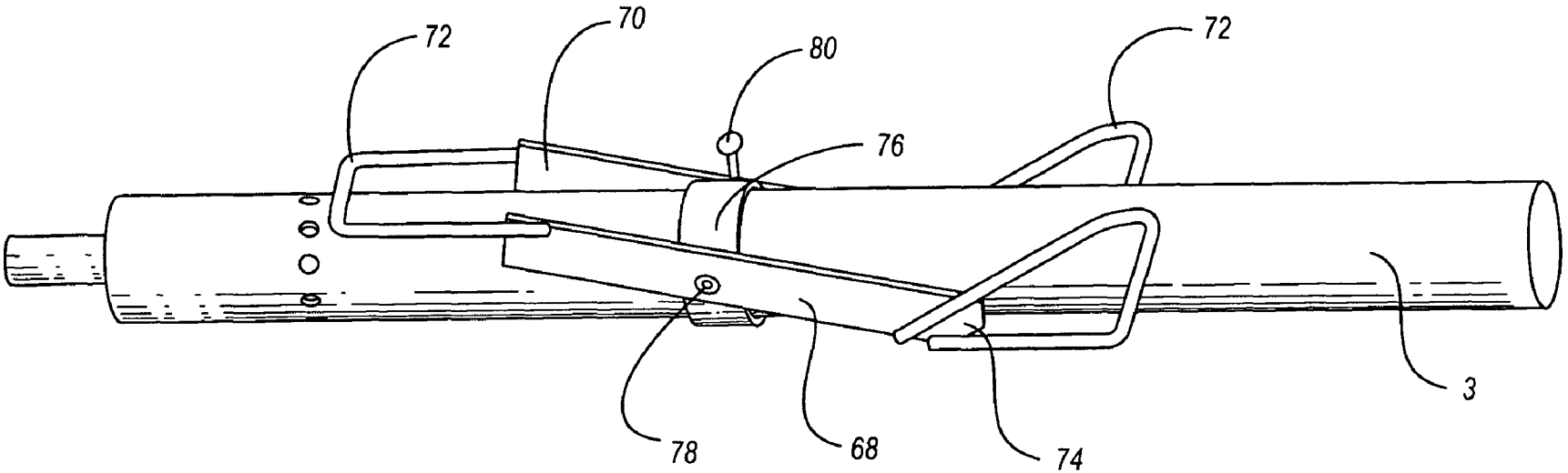
FIG. 14 is a side view of a handle coupled with a base cylinder.
Figure 15:
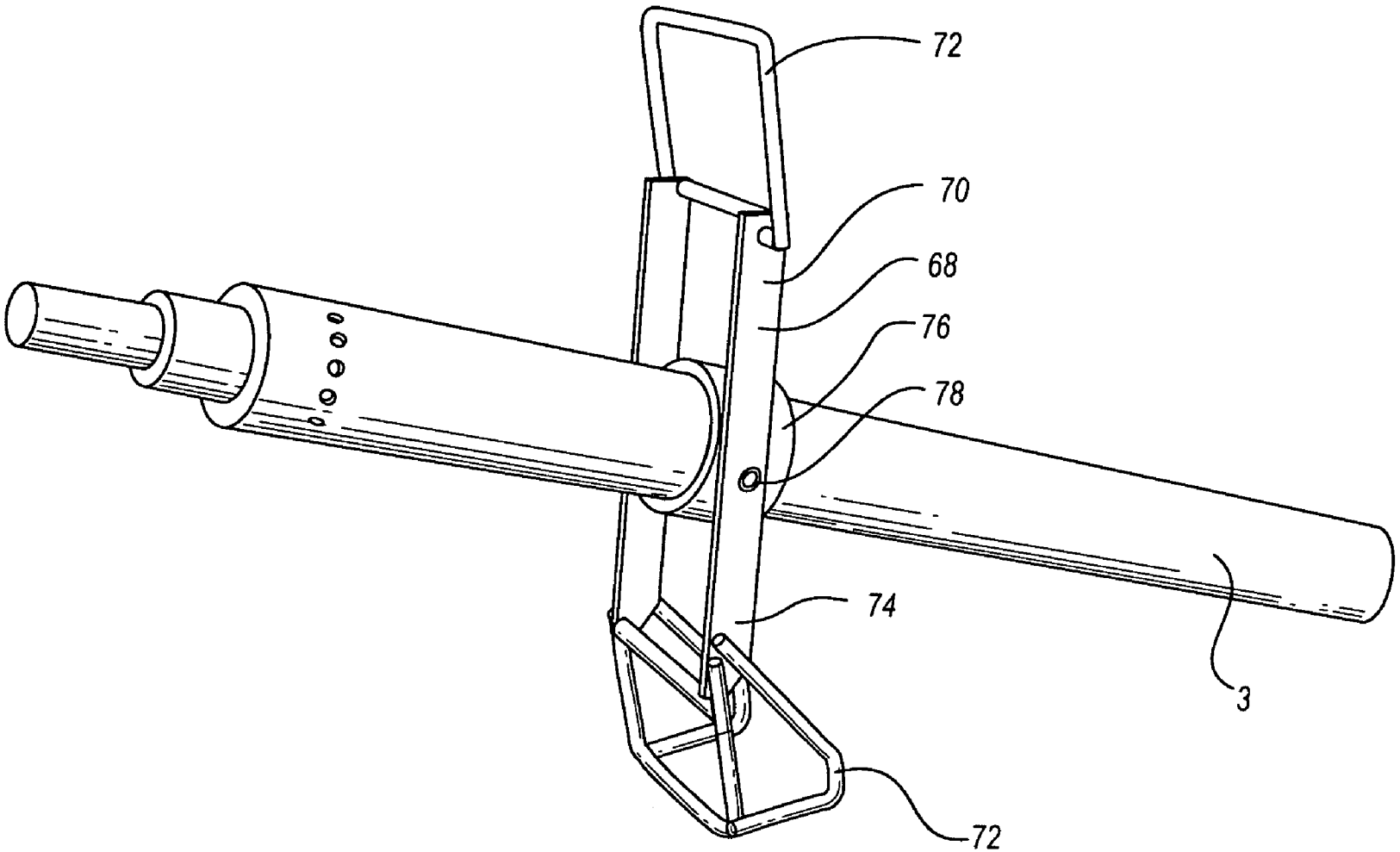
FIG. 15 is a perspective view of a handle coupled with a base cylinder in a first position.
Figure 16:
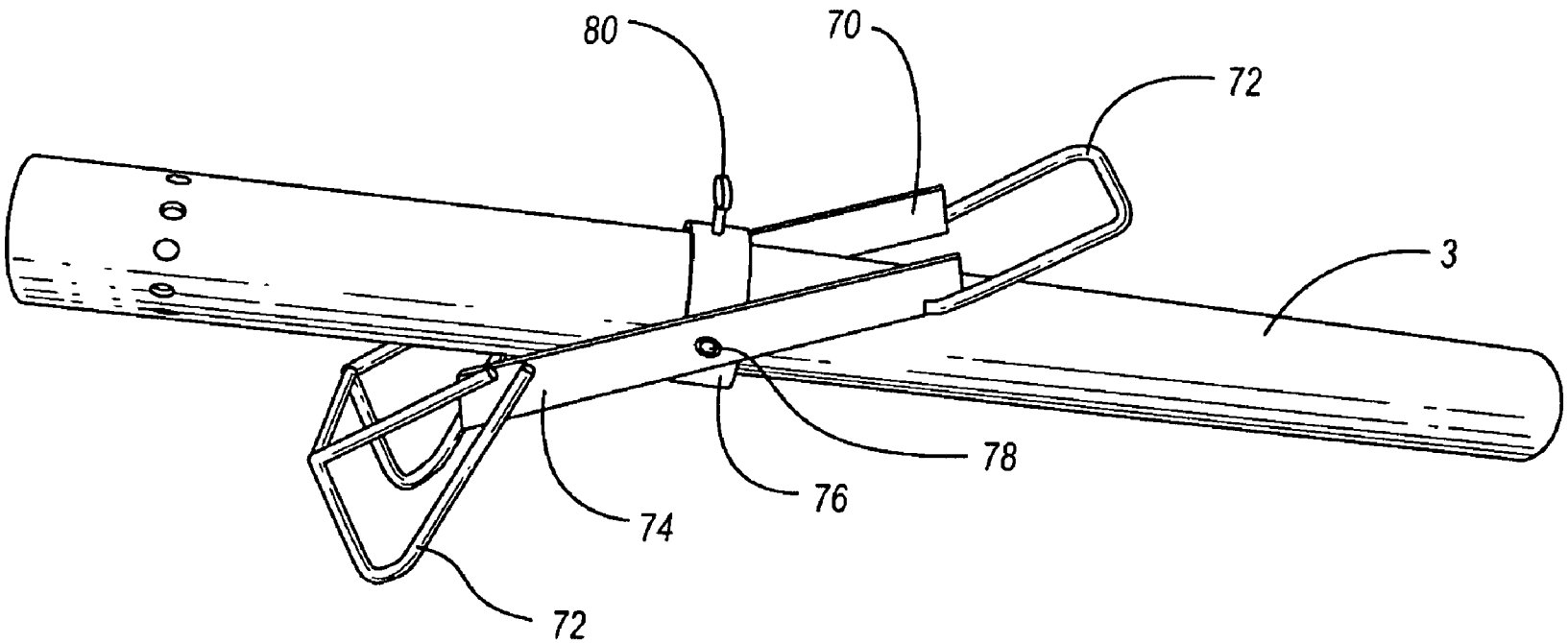
FIG. 16 is a perspective view of a handle coupled with a base cylinder in a first position.

FIGS. 13-16 illustrate a first particular implementation of a handle assembly. In particular, FIG. 13 illustrates a perspective view of a handle assembly 66. Handle assembly 66 comprises handle 67, which comprises two opposing side members 68 that are coupled with a forward portion 70 comprising one or more grips 72. The two opposing side members 68 are further coupled with rear portion 74, which also comprises one or more grips 72. Cuff 76 is pivotably coupled with handle 67 via at least two opposing pivots 78. In the particular implementation shown, cuff 76 is pivotably coupled between two opposing side members 68 and is located between the two opposing side members 68, as well as between forward portion 70 and rear portion 74. Cuff 76 is rotatably pivotable with respect to handle 67, and may comprise one or more set screws 80 which are configured to couple a device (such as extendable sprinkler device 2) with handle assembly 66 via the impingement of an outer surface of the device between cuff 76 and the one or more set screws 80 (as illustrated in FIGS. 14-16). In some particular implementations, handle assembly 66 may be permanently coupled with base cylinder 3 such as, by way of non-limiting example, welding. It will likewise be understood that fasteners other than set screws 80 may be used to effectuate the coupling of handle assembly 66 with base cylinder 3.

FIGS. 14-16 illustrate a first particular implementation of a handle assembly coupled with extendable sprinkler device 2. With base cylinder 3 passed through cuff 76, a user may thereafter tighten set screw 80 so that set screw 80 contacts an outer surface of base cylinder 3, thereby fixing base cylinder 3 within cuff 76. In some particular implementations, handle assembly 66 may be permanently pivotably coupled (fixed) with base cylinder 3. In other particular implementations, handle assembly 66 may be removably pivotably coupled (fixed) with base cylinder 3. A comparison of FIGS. 14, 15 and 16 illustrates that handle 67 is pivotably moveable with respect to cuff 76 between a variety of positions. In particular, FIG. 14 illustrates handle 67 in a first position with respect to base cylinder 3. FIG. 15 illustrates handle 67 in a second position with respect to base cylinder 3. FIG. 16 illustrates handle 67 in a third position with respect to base cylinder 3. Notwithstanding the particular position of handle 67 with respect to base cylinder 3, handle 67 may also serve as a base upon which to orient base cylinder 3 into a desired position. In particular, a comparison of FIGS. 14-16 shows that base cylinder 3 may be oriented and maintained in a variety of positions with respect to handle 67, depending upon, among other things, the particular orientation of handle 67 with respect to base cylinder 3.

It will be understood by those of ordinary skill in the art that the concepts of using base cylinders, primary extension assemblies, secondary extension cylinders, and tertiary extension cylinders to extend and maintain a sprinkler in an extended position, as disclosed herein, is not limited to extendable sprinklers or to the specific implementations shown herein. For example, it is specifically contemplated that the components included in a particular implementation of an extendable sprinkler device may be formed of any of many different types of materials or combinations that can readily be formed into shaped objects and that are consistent with the intended operation of an extendable sprinkler device. For example, the components and implementing components may be formed of: rubbers (synthetic and/or natural) and/or other like materials; polymers and/or other like materials; plastics, and/or other like materials; composites and/or other like materials; metals and/or other like materials; alloys and/or other like materials; and/or any combination of the foregoing.

Furthermore, in addition to the foregoing, there are a variety of extendable sprinkler aspects, of which one, a plurality, or all may be included in any particular implementation. The base cylinder, primary extension cylinder, actuator cylinder, secondary extension cylinder, and tertiary extension cylinder, and any other components forming a particular implementation of an extendable sprinkler device may be manufactured separately and then assembled together, or any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled or removably coupled with one another in any manner, depending upon, among other considerations, the particular material(s) forming the components.

It will be understood that particular implementations are not limited to the specific components disclosed herein, as virtually any components consistent with the intended operation of a method and/or system implementation for an extendable sprinkler device may be utilized. Accordingly, for example, although particular base cylinders, primary extension assemblies, secondary extension cylinders, and tertiary extension cylinders may be disclosed, such components may comprise any shape, size, style, type, model, version, class, grade, measurement, concentration, material, weight, quantity, and/or the like consistent with the intended operation of a method and/or system implementation for an extendable sprinkler device may be used.

In places where the description above refers to particular implementations of an extendable sprinkler device, it should be readily apparent that a number of modifications may be made without departing from the spirit thereof and that these implementations may be applied to other extendable sprinkler devices. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

Many additional extendable sprinkler device implementations are possible. For the exemplary purposes of this disclosure, in some implementations, the tertiary extension cylinder may not be included. In other implementations, a nozzle may not be included. For the exemplary purposes of this disclosure, in some implementations, an extendable sprinkler device may extend telescopically. For example, in some particular implementations, an extendable sprinkler device may extend to less than 12 feet in length. In other particular implementations, an extendable sprinkler device may extend to more than 12 feet in length. Any of the foregoing components and/or other extendable sprinkler devices may be rated from about 40 p.s.i. to about 5,000 p.s.i.

It will be understood that extendable sprinkler device implementations are not limited to the specific assemblies, devices and components disclosed in this document, as virtually any assemblies, devices and components consistent with the intended operation of a misting tower implementation may be utilized. Accordingly, for example, although particular extendable sprinkler devices, base cylinders, primary extension assemblies, primary extension cylinders, actuator cylinders, secondary extension cylinders, tertiary extension assemblies, water supply fittings, bushings, end caps, water outlets, flanges, stops, valves, cuffs, perforations, nozzles, and handle assemblies are disclosed, such may comprise any shape, size, style, type, model, version, class, measurement, concentration, material, weight, quantity, and/or the like consistent with the intended operation of an extendable sprinkler device implementation. Implementations are not limited to uses of any specific assemblies, devices and components; provided that the assemblies, devices and components selected are consistent with the intended operation of an extendable sprinkler device implementation.

Implementations of extendable sprinkler devices and implementing components may be constructed of a wide variety of materials. For example, the components may be formed of: polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; glasses (such as fiberglass), carbon-fiber, aramid-fiber, any combination thereof, and/or other like materials; composites and/or other like materials; metals, such as zinc, magnesium, titanium, copper, lead, iron, steel, carbon steel, alloy steel, tool steel, stainless steel, brass, tin, antimony, aluminum, any combination thereof, and/or other like materials; alloys, such as aluminum alloy, titanium alloy, magnesium alloy, copper alloy, any combination thereof, and/or other like materials; any other suitable material; and/or any combination of the foregoing thereof. For the exemplary purposes of this disclosure, components may comprise a plastic material like a polyvinyl chloride (PVC).

Some components defining an extendable sprinkler device and extendable sprinkler device assembly implementations may be manufactured simultaneously and integrally joined with one another, while other components may be purchased pre-manufactured or manufactured separately and then assembled with the integral components. Various implementations may be manufactured using conventional procedures as added to and improved upon through the procedures described here.

Accordingly, manufacture of these components separately or simultaneously may involve vacuum forming, injection molding, blow molding, casting, forging, cold rolling, milling, drilling, reaming, turning, grinding, stamping, pressing, cutting, bending, welding, soldering, hardening, riveting, punching, plating, and/or the like. Components manufactured separately may then be coupled or removably coupled with the other integral components in any manner, such as with adhesive, a weld joint, a solder joint, a fastener (e.g. a bolt and a nut, a screw, a rivet, a pin, and/or the like), washers, retainers, wrapping, wiring, any combination thereof, and/or the like for example, depending on, among other considerations, the particular material forming the components.

The invention claimed is:

1. An extendable sprinkler device comprising:

a base cylinder comprising a first end fluidly communicable with a second end via a through passageway having a first interior diameter;

a primary extension assembly slidably coupled within the through passageway of the base cylinder and positionable between a collapsed position and an extended position, the primary extension assembly comprising:

a primary extension cylinder comprising a first end fluidly communicable with a second end via a through passageway having a second interior diameter and a first exterior diameter smaller than the first interior diameter, the first end having a stop coupled thereto; and an actuator cylinder coupled with and located fixed inside the through passageway of the primary extension cylinder, the actuator cylinder comprising:

a first end fluidly communicable with a second end via a through passageway having a third interior diameter and a second exterior diameter smaller than the second interior diameter, wherein the second end of the actuator cylinder is coupled with the second end of the primary extension cylinder; and one or more outlet slots disposed adjacent to its second end;

a secondary extension cylinder comprising a first end fluidly communicable with a second end via a through passageway having a fourth interior diameter and a third exterior diameter smaller than the third interior diameter slidably coupled within the through passageway of the actuator cylinder and positionable between a collapsed position and an extended position, wherein the one or more outlet slots are in fluid communication with the first end of the actuator cylinder when the secondary extension cylinder is in the extended position.

2. The device of claim 1, wherein the first end of the base cylinder is coupled with a water supply fitting.

3. The device of claim 1, wherein the base cylinder further comprises at least two perforations disposed adjacent to the second end of the base cylinder.

4. The device of claim 3, wherein the at least two perforations are in fluid communication with the first end of the base cylinder when the primary extension assembly is in the extended position.

5. The device of claim 3, wherein the stop of the primary extension cylinder is interposed between the at least two perforations and the second end of the base cylinder when the primary extension assembly is in the extended position.

6. The device of claim 3, wherein the at least two perforations are not in fluid communication with the first end of the base cylinder, and wherein the stop of the primary extension cylinder is interposed between the first end of the base cylinder and the at least two perforations when the primary extension assembly is in the collapsed position.

7. The device of claim 1, wherein the primary extension assembly is substantially coextensive with the through passageway of the base cylinder when the primary extension assembly is in the collapsed position.

8. The device of claim 1, wherein the second end of the primary extension cylinder comprises an end cap coupled thereto.

9. The device of claim 1, wherein the first end of the secondary extension cylinder comprises one or more stops coupled thereto.

10. The device of claim 9, wherein at least one of the one or more stops of the secondary extension cylinder is interposed between the one or more outlet slots and the second end of the actuator cylinder when the secondary extension cylinder is in the extended position.

11. The device of claim 9, wherein the one or more outlet slots are not in fluid communication with the first end of the actuator cylinder, and wherein at least one of the one or more stops of the secondary extension cylinder is interposed between the first end of the actuator cylinder and the one or more outlet slots when the secondary extension cylinder is in the collapsed position.

12. The device of claim 1, wherein the secondary extension cylinder and the actuator cylinder are substantially coextensive when the secondary extension cylinder is in the collapsed position.

13. The device of claim 1, wherein the secondary extension cylinder comprises a spray nozzle coupled with its second end.

14. The device of claim 1, wherein the secondary extension cylinder comprises at least two perforations disposed adjacent to its second end.

15. The device of claim 14, further comprising a tertiary extension cylinder slidably coupled within the secondary extension cylinder and positionable between a collapsed position and an extended position, the tertiary extension cylinder comprising a first end fluidly communicable with a second end via a through passageway having a fifth interior diameter and a fourth exterior diameter smaller than the fourth interior diameter, the first end having one or more stops coupled thereto.

16. The device of claim 15, wherein the at least two perforations of the secondary extension cylinder are in fluid communication with the first end of the secondary extension cylinder when the tertiary extension cylinder is in the extended position.

17. The device of claim 15, wherein the stop of the tertiary extension cylinder is interposed between the at least two perforations and the second end of the secondary extension cylinder when the tertiary extension cylinder is in the extended position.

18. The device of claim 15, wherein the stop of the tertiary extension cylinder is interposed between the first end of the secondary extension cylinder and the at least two perforations of the secondary extension cylinder when the tertiary extension cylinder is in the collapsed position.

19. The device of claim 15, wherein the tertiary extension cylinder comprises a spray nozzle coupled with its second end.

20. The device of claim 1, further comprising a handle assembly coupled with the base cylinder, the handle assembly comprising:

a handle comprising two opposing side members coupled with a forward portion having one or more grips and a rear portion having one or more grips; and a cuff pivotably coupled with the handle via two opposing pivots coupled with the opposing side members, the cuff located between the at least two opposing side members and the forward portion and the rear portion of the handle.

* * * * *